US006817555B2

(12) United States Patent
Reichler et al.

(10) Patent No.: US 6,817,555 B2
(45) Date of Patent: Nov. 16, 2004

(54) HIGH-SPEED ROTARY ATOMIZER FOR APPLYING POWDER COATING

(75) Inventors: Jan Reichler, Constance (DE); Erich Meyer, Kriegstetten (CH)

(73) Assignee: Eisenman Lacktechnik KG (DE)

( * ) Notice: Subject to any disclaimer, the term of this patent is extended or adjusted under 35 U.S.C. 154(b) by 0 days.

(21) Appl. No.: 09/999,773

(22) Filed: Oct. 24, 2001

(65) Prior Publication Data

US 2002/0088394 A1 Jul. 11, 2002

(30) Foreign Application Priority Data

Oct. 27, 2000 (DE) ..... 100 53 296

(51) Int. Cl.[7] ..... B05B 5/00

(52) U.S. Cl. ..... 239/700; 239/702; 239/703; 239/690

(58) Field of Search ..... 239/703, 690–708

(56) References Cited

U.S. PATENT DOCUMENTS 4,572,437 A * 2/1986 Huber et al. ..... 239/703
4,844,348 A * 7/1989 Rutz ..... 239/703
5,106,025 A * 4/1992 Giroux et al. ..... 239/703
5,697,559 A * 12/1997 Davis et al. ..... 239/703
5,862,988 A * 1/1999 van der Steur ..... 239/703

FOREIGN PATENT DOCUMENTS

| | | |
|---|---|---|
| DE | 31 14 314 | 10/1983 |
| DE | 39 31 726 | 4/1990 |
| DE | 26 39 116 | 3/1991 |
| EP | 0 857 515 | 8/1998 |

* cited by examiner

*Primary Examiner*—Dinh Q. Nguyen
(74) *Attorney, Agent, or Firm*—Factor & Lake

(57) ABSTRACT

A high-speed rotary atomiser for applying powder coating includes a housing together with a rotatable bell disc arranged at the front of housing A guidance air arrangement in the form of a rotationally symmetrical air guidance body coaxial to bell disc is provided for shaping the powder cloud generated by the high-speed rotary atomizer, which air guidance body is mounted on the front of housing. Air guidance body has a jacket surface to which guidance air be so supplied that it flows forwards along jacket surface as a substantially rotationally symmetrical air curtain along jacket surface. The air curtain flowing over the jacket surface of air guidance body impinges on the powder cloud generated by bell disc and shapes it according to the quantity and velocity of the air curtain and according to the geometry of air guidance body.

8 Claims, 2 Drawing Sheets

HIGH-SPEED ROTARY ATOMIZER FOR APPLYING POWDER COATING

BACKGROUND OF THE INVENTION

1. Field of the Invention

The present invention relates to high-speed rotary atomisers for applying powder coating. Such atomisers comprise a housing; a rotatable bell disc arranged at the front of the housing; a motor driving the bell disc accommodated in the housing; at least one powder supply channel passing through the housing and emerging at the front of the housing and a guidance air arrangement with which pressurised guidance air is blowable in the direction of the powder cloud generated by the bell-shaped disc.

2. Background Art

High-speed rotary atomisers have been increasingly used in recent times for the application of powdered coatings. The powder cloud generated by high-speed rotary atomisers needs to be shaped. To shape the powder cloud generated by such an atomiser, guidance air arrangements in the form of a plurality of bore holes arranged at the front of the housing are used. Pressurised guidance air emerges from these bore holes towards the powder cloud and produces the desired shaping effect. A disadvantage of this known guidance air arrangement is that as the guidance air passes through the different bore holes, it forms turbulence which has a detrimental effect on the powder cloud. In addition, the quantity of guidance air which can be supplied to the powder cloud in this way is limited.

SUMMARY OF THE INVENTION

An object of the present invention is to configure a high-speed rotary atomiser of the type described above such that the guidance air flows towards the powder cloud as uniformly and as free of turbulence as possible.

In the present invention, the guidance air arrangement includes a rotationally symmetrical air guidance body attached to the front of the housing and a jacket surface to which the guidance air can be so fed that it flows out forwards along the jacket surface as a substantially rotationally symmetrical air curtain, the air guidance body having an axial through-bore through which the coating powder flows towards the bell disc.

According to the invention, therefore, the guidance air is not passed through small bore holes but along an external jacket surface of a more or less solid body, without the guidance air being subjected to any radially outward physical restriction. The guidance air curtain has no interruptions and is therefore not divided into separate streams, which could only be reunited while generating turbulence. Moreover, relatively large quantities of guidance air can be moved over the relatively large jacket surface of the air guidance body, so that the effect of the guidance air on the powder cloud is far greater than with known high-speed rotary atomisers.

An especially preferred embodiment of the invention is that in which a rear, radial surface of the air guidance body and a part adjacent to it delimit a radial gap through which guidance air can flow radially outwards, the jacket surface of the air guidance body having in its forward section a conoidal surface narrowing conically towards the front and a transitional section connecting the rear radial surface with the conoidal jacket surface. In this embodiment, because the guidance air first flows radially through the gap but then is diverted forwards, a reinforcement of the air stream takes place in that surrounding air is drawn along by the guidance air fed from within. The air flowing forwardly along the jacket surface of the air guidance body is therefore composed of the guidance air supplied and the surrounding air drawn with it. This, too, increases the possibility of influencing the shape of the powder cloud.

It is preferred in this embodiment that the transitional section be composed of a plurality of conical annular faces with differing cone angles. In such an embodiment the guidance air "adheres" better to the jacket surface of the air guidance body when diverted from the radial to a substantially axial flow direction than if said surface formed a continuous curve.

It is also advantageous if an annular space communicating with the gap bordering the air guidance body is provided in the housing to conduct the guidance air. Within this annular space an equalisation of pressure can take place, further homogenising the guidance air stream.

An especially favourable possibility of communication between annular space and gap is a screw thread-like groove cut into an axial surface of a part bordering the annular space.

When using the air guidance body according to the invention it can occur that the air flowing along the jacket surface of the air guidance body has a higher pressure at the front end of said air guidance body, where the through-bore emerges, than the powder stream flowing through the through-bore. This can cause unwanted turbulence. To prevent this, according to a further embodiment of the present invention a supporting air arrangement can be provided by which pressurised supporting air can be so fed into the powder stream flowing through the through-bore of the air guidance body that the pressure prevailing at the mouth of the through-bore does not fall below the pressure prevailing at the jacket surface in that area. In this way turbulence which could disturb the formation of the powder cloud can be reliably avoided.

BRIEF DESCRIPTION OF THE DRAWINGS

An embodiment of the invention is explained in more detail below with reference to the drawings, in which.

BEST MODE FOR PRACTICING THE INVENTION

Figure 1:
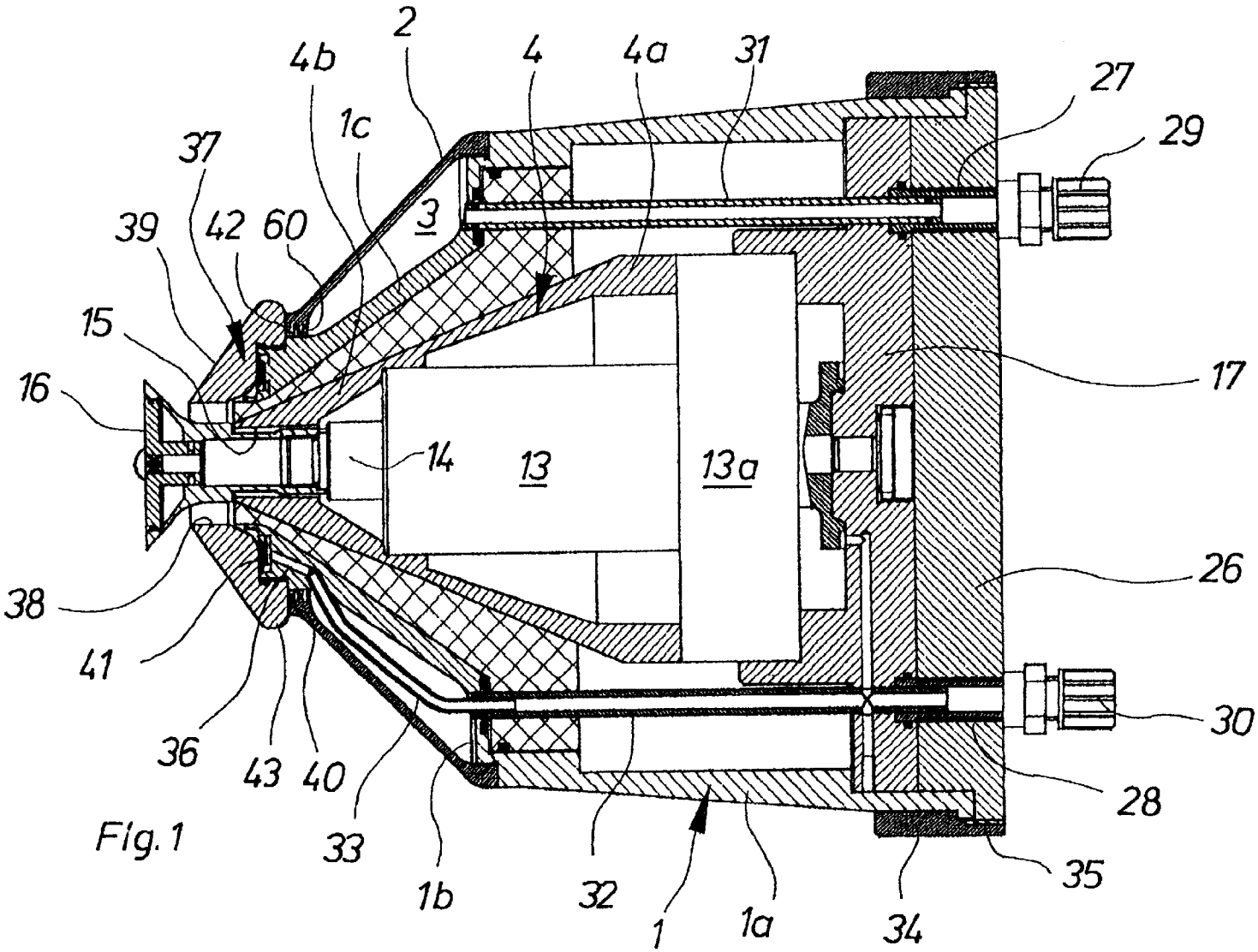
FIG. 1: shows an axial section through a high-speed rotary atomiser.

The high-speed rotary atomiser illustrated in FIG. 1 has a housing 1 composed in one piece of a rear housing section 1*a*, a radial annular shoulder 1*b* and a front housing section 1*c*. Rear housing section la widens with a small cone angle towards the rear of the high-speed rotary atomiser; front housing section 1*c* is also conical, although its cone angle is larger than that of rear housing section 1*a*. Housing 1 consists entirely of plastics material.

From the radially outside edge of stage 1*b* of housing 1 a likewise conical annular part 2, also made of plastics material, runs to the front portion of the outer jacket surface of front housing section 1*c*. Annular part 2 is sealed at its circular edge adjacent to the annular shoulder 1*b* of housing 1, while a groove 60 in the form of a trapezoidal thread is formed, for reasons which will become clear later, in the inner jacket surface of its front section, which abuts against the front portion of housing section 1*b*. This groove 60 forms a connection between annular space 3, located between annular part 2 and housing 1, and the front end face of annular part 2.

An electrode insert 4 is arranged coaxially inside housing 1, and has a cylindrical rear portion 4*a* relatively short in the axial direction and a conical front portion 4*b*. Front portion 4*b* of electrode insert 4 ends in the vicinity of the front end of front housing section 1*c*.

An air-driven motor 13, the shaft 14 of which runs coaxially with housing 1 and with electrode insert 4 and passes through a through-bore 15 in electrode insert 4, is inserted in the suitably stepped interior of electrode insert 4. The hub of a bell disc 16 is so locked on to shaft 14 that bell disc 16 rotates together with shaft 14.

Motor 13 is defined by means of a section 13*a* of electrode insert 4 which has a larger radius. This happens because motor section 13*a* is clamped between the rear end face of electrode insert 4 and a pot-shaped retaining insert 17. This is effected by means of screws, not shown, passing through through-bores in motor section 13*a* and screwed into threaded holes in electrode insert 4.

The rearward end of housing 1 is closed by a connector plate 26 which abuts on the rear face of retaining insert 17, carries various air connections not shown in the drawing and additionally serves as an attachment to the arm of a robot, also not shown. Connector plate 26 is fixed to housing 1 by means of a union nut 34 which abuts against a circumferential step on housing 1 and is screwed on to an external thread 35 on connector plate 26.

Two bushes 27, 28 pass through connector plate 26 and project inwardly beyond connector plate 26 and into a stepped bore in retaining insert 17. Connector nipples 29, 30 to which compressed air supply hoses can be connected are attached to the outside of connector bushes 27, 28 respectively.

Figure 2:
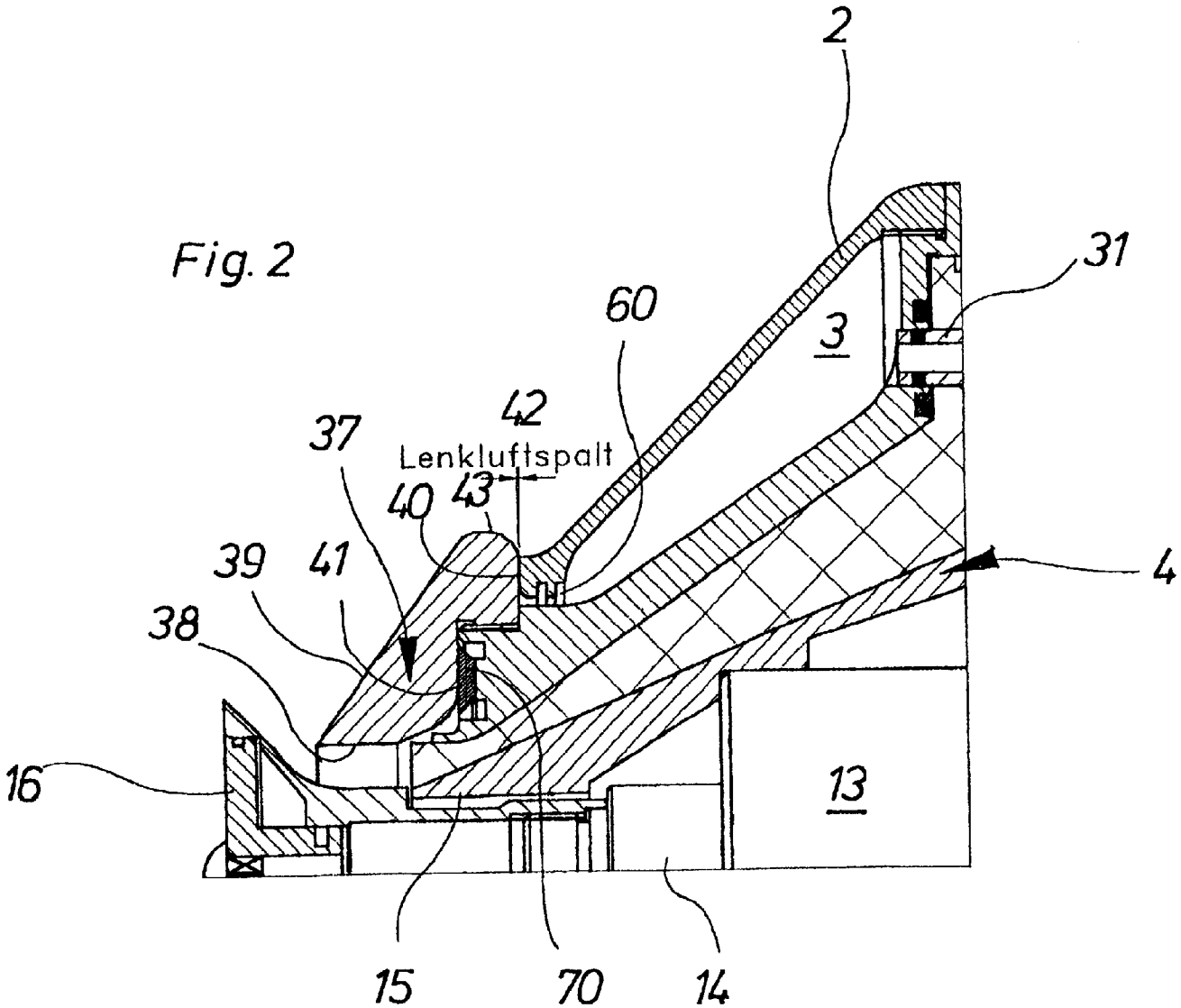
FIG. 2: shows a detail enlargement from FIG. 1.

A tube 31 extends from connector bush 27 through the stepped bore of retaining insert 17 and through a bore in annular shoulder 1*b* of housing 1 and opens into annular space 3, which is located between annular part 2 and front housing section 1*c*. A further tube 32 leads from connector bush 28 through the corresponding stepped bore of retaining insert 17 and through a further bore in annular shoulder 1*b* of housing 1. Attached to this tube 32 is a further, angled tube 33 which passes through annular space 3 and is inserted into a bore 36 in front housing section 1*c*. Bore 36 opens into a groove in the front annular end face of front housing section 1*c*. As can be seen in FIG. 2, a ring 70 of soft plastics material, e.g. PTFE, which abuts radially with a sealing edge against an external face of housing section 1*c*, is located in this groove.

In addition, the high-speed rotary atomiser has two powder supply channels, not shown in the drawing, which lead from a connection for the coating powder arranged on connector plate 26 to an annular gap between electrode insert 4 and front housing section 1*c*. These two powder supply channels pass through the space located radially outside motor 13.

An air guidance body 37 is fitted to the front end of front housing section 1*c*. It has a through-bore 38 which surrounds the hub of bell disc 16 with clearance. On its front face air guidance body 37 has a conically narrowing conoidal jacket surface 39. The rear face of air guidance body 37 includes two radial annular faces 40, 41 connected by a step. Between annular face 40, which lies radially further out, and the end face of annular part 2 there remains a narrow, radially directed gap 42. Ring 70 abuts against annular face 41 of air guidance body 37, which face lies radially further inwards.

Annular face 40 of air guidance body 37, located radially outside, is connected to conoidal face 39 by a transitional section 43, which is composed of juxtaposed conical faces.

The high-speed rotary atomiser which has been described operates as follows:

The coating powder supplied via powder supply channels, not illustrated, brushes along metal faces of electrode insert 4 and is thereby directly ionised. In this ionised form it passes through the outlet gap of the powder supply channels located between the front end of housing 1 and the front end of electrode insert 4, passes through through-bore 38 of air guidance body 37 and is then swirled by rotating bell disc 16.

Compressed air is supplied to annular space 3 between annular part 2 and front housing section 1*c* via connector nipple 29 and tube 30. This compressed air is distributed in annular space 3. It emerges via trapezoidal thread 60 in the front end section of annular part 2 into gap 42 between air guidance body 37 and annular part 2, flows radially outwards along this gap 42 and is then diverted by transitional section 43 of air guidance body 37. With the aid of the conical annular faces which prevent detachment and swirling of this air stream, the air attaches itself to conical face 39 of air guidance body 37 and flows towards the powder cloud generated by rotating bell disc 16. The nature of the flow along air guidance body 37 is such that at the same time surrounding air is drawn into the stream so that the total stream flowing along the front section of air guidance body 37 is considerably reinforced. This combined stream of air flowing through gap 42 and air sucked in from the surrounding air now shapes the powder cloud generated by rotating bell disc 16.

This air flows via connector nipple 30, tubes 32, 33 and bore 36 in front housing section 1*c* into the annular space between ring 70 and the front end face of front housing section 1*c*. When a certain minimum pressure is reached the sealing edge of ring 70 is lifted away from housing section 1*c* and allows air to pass. In this way the air enters the front section of the powder supply channels and increases the pressure of the stream flowing through passage 38 in air guidance body 37. In this way the pressure in through-bore 38 of air guidance body 37 is prevented from falling below that of the guidance air flowing along conoidal face 39, which could cause turbulence at the point where the coating powder stream emerges from air guidance body 37. For this reason the compressed air supplied via connector nipple 30 is also called "supporting air" here.

By controlling the pressure of the guidance air inside annular space 3, by the selection of the geometry of groove 60 in annular part 2 and of gap 42 between air guidance body 37 and annular part 2, and by the selection of the geometry of air guidance body 37 itself, the shape of the powder cloud generated by the high-speed rotary atomiser can be influenced largely as desired; in particular, very slender powder clouds with a small diameter, as desired for many applications, can be produced.

We claim:

1. A high-speed rotary atomiser for applying powder coating comprising:

a housing;

a rotatable bell disc arranged at the front of the housing;

a motor driving the bell disc accommodated in the housing;

at least one powder supply channel passing through the housing and emerging at the front of the housing and;

a guidance air arrangement associated coaxially with the bell disc, to, in turn, facilitate the blowing of guidance air under pressure, the guidance air arrangement comprising:

an air guidance body mounted at the front of the housing, the air guidance body being rotationally symmetrical and having an axial through-bore through which coating powder is capable of flowing in the direction of the bell disc; and a jacket surface to which guidance air can be supplied so as to flow forward therealong as a substantially rotationally symmetrical air curtain.

2. A high-speed rotary atomiser according to claim 1, in which the air guidance body of the guidance air arrangement further comprises a rear, radial face and an adjacent part which delimit a radial gap through which guidance air can flow radially outwards; and the jacket surface of the air guidance body further comprises in its front section a conoidal jacket surface narrowing conically towards the front thereof and a transitional section connecting the rear radial face to the conoidal jacket surface.

3. A high-speed rotary atomiser according to claim 2, in which the transitional section further comprises a plurality of conical annular faces with differing cone angles.

4. A high-speed rotary atomiser according to claim 2, in which the housing further comprises a guidance air conducting annular space communicating with a gap bordering the air guidance body.

5. A high-speed rotary atomiser according to claim 4, further comprising a screw thread-like groove cut into an axial surface of a part bordering the annular space to provide communication with the gap.

6. A high-speed rotary atomiser according to claim 1, further comprising a supporting air arrangement to facilitate the feeding of pressurised supporting air into the through-bore of the air guidance body such that the pressure prevailing at the point where through-bore emerges does not fall below the pressure prevailing on the jacket face at that point.

7. A high-speed rotary atomiser for applying powder coating comprising:

a housing;

a rotatable bell disc arranged at the front of the housing;

a motor driving the bell disc accommodated in the housing;

at least one powder supply channel passing through the housing and emerging at the front of the housing and;

a guidance air arrangement associated coaxially with the bell disc, to, in turn, facilitate the blowing of guidance air under pressure, the guidance air arrangement comprising:

an air guidance body mounted at the front of the housing, the air guidance body being rotationally symmetrical including an axial through-bore through which coating powder is capable of flowing in the direction of the bell disc, and further including a rear, radial face and an adjacent part which delimit a radial gap through which guidance air can flow radially outwards; and a jacket surface to which guidance air can be supplied so as to flow forward therealong as a substantially rotationally symmetrical air curtain, the jacket surface further comprising in its front section a conoidal jacket surface narrowing conically towards the front thereof and a transitional section connecting the rear radial face to the conoidal jacket surface, the transitional section further comprising a plurality of conical annular faces with differing cone angles.

8. A high-speed rotary atomiser for applying powder coating comprising:

a housing, including:

a guidance air conducting annular space;

a gap; and a screw thread-like groove cut into an axial surface of a part bordering the guidance air conducting annular space, the screw thread-like groove providing communication between the gap and the guidance air conducting annular space;

a rotatable bell disc arranged at the front of the housing;

a motor driving the bell disc accommodated in the housing;

at least one powder supply channel passing through the housing and emerging at the front of the housing and;

a guidance air arrangement associated coaxially with the bell disc, to, in turn, facilitate the blowing of guidance air under pressure, the guidance air arrangement comprising:

an air guidance body mounted at the front of the housing and bordering the gap of the housing, the air guidance body being rotationally symmetrical including an axial through-bore through which coating powder is capable of flowing in the direction of the bell disc, and further including a rear, radial face and an adjacent part which delimit a radial gap through which guidance air can flow radially outwards; and a jacket surface to which guidance air can be supplied so as to flow forward therealong as a substantially rotationally symmetrical air curtain, the jacket surface further comprising in its front section a conoidal jacket surface narrowing conically towards the front thereof and a transitional section connecting the rear radial face to the conoidal jacket surface.

* * * * *